US006194827B1

(12) United States Patent
Atagi

(10) Patent No.: US 6,194,827 B1
(45) Date of Patent: Feb. 27, 2001

(54) LOW PRESSURE MERCURY VAPOR DISCHARGE LAMP WITH MERCURY-RELEASING METAL SUBSTRATE AND METHOD OF MAKING THE SAME

(75) Inventor: Toshikazu Atagi, Osaka (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/157,490

(22) Filed: Sep. 21, 1998

(30) Foreign Application Priority Data

Sep. 26, 1997 (JP) ..... 9-261684

(51) Int. Cl.[7] ..... H01J 1/62

(52) U.S. Cl. ..... 313/493; 313/490; 445/26; 445/27; 445/9

(58) Field of Search ..... 445/9, 26, 27, 445/490; 313/491, 493, 638, 639, 565

(56) References Cited

U.S. PATENT DOCUMENTS 4,228,715 * 10/1980 Van Overveld et al. ..... 313/174
5,879,216 * 3/1999 Yoshii et al. ..... 445/9
5,882,237 * 3/1999 Sarver et al. ..... 445/9

FOREIGN PATENT DOCUMENTS 7-211235 8/1995 (JP) .
9-45282 2/1997 (JP) .
WO 94-18692 8/1994 (WO) .

* cited by examiner

*Primary Examiner*—Nimeshkumar D. Patel
*Assistant Examiner*—Joseph Williams
(74) *Attorney, Agent, or Firm*—Merchant & Gould P.C.

(57) ABSTRACT

A low pressure mercury vapor discharge lamp includes a bulb and a mercury-releasing metal substrate, in particular, an alloy of zinc and mercury in which the mercury-releasing metal substrate has an inside part crystallized in a plate form or in a granular form and a surface on which a mercury-rich layer is formed. The mercury-releasing metal substrate, in particular, the alloy of zinc and mercury, can be adhered firmly to the inside face of the bulb. Moreover, the low pressure mercury vapor discharge lamp can be made by putting a mercury-releasing metal substrate into a bulb; forming a mercury-rich layer on the surface of the mercury-releasing metal substrate while crystallizing the inside of the mercury-releasing metal substrate in a plate form or in a granular form by heating the bulb from the outside; and softening the mercury-releasing metal substrate to adhere it to the inside face of the bulb.

15 Claims, 5 Drawing Sheets

LOW PRESSURE MERCURY VAPOR DISCHARGE LAMP WITH MERCURY-RELEASING METAL SUBSTRATE AND METHOD OF MAKING THE SAME

FIELD OF THE INVENTION

The present invention relates to a low pressure mercury vapor discharge lamp using a mercury-releasing metal substrate as a method for providing mercury to a bulb and to a method for manufacturing the same.

BACKGROUND OF THE INVENTION

In a circular fluorescent lamp, mercury typically is provided to bulb, using a method of filling mercury in a bulb, a method of dropping and introducing liquid mercury into the bulb directly from an exhaust-pipe (vacuum-pipe) (hereinafter, "a dropper method" will be referred to). Since it is difficult to control the filling amount of mercury by the dropper method, a great amount of mercury has to be used so as to ensure the reliability of products. However, since mercury is a harmful substance for the environment, it is desirable to minimize the amount of mercury.

In order to reduce the amount of mercury, alternative methods to the dropper method have been considered. One such method includes filling only a required amount of mercury by providing a mercury-releasing metal substrate, for example, an alloy of zinc and mercury inside a bulb. However, in a case where the mercury-releasing metal substrate is merely put into the bulb, the mercury-releasing metal substrate moves freely inside the bulb. As a result, the mercury-releasing metal substrate makes noises or peels off an inner fluorescent film. To overcome this, the mercury-releasing metal substrate is adhered to the inside face of the bulb by bringing the mercury-releasing metal substrate into contact with a seal part of the end of the bulb and then heating the bulb from the outside.

As a method of heating the bulb from the outside, a method of heating by a furnace, burner, or the like, is employed. However, under the conventional heating conditions, the mercury-releasing metal substrate cannot be adhered or is insufficiently adhered to the bulb, so that the mercury-releasing metal substrate is often peeled off from the bulb.

SUMMARY OF THE INVENTION

It is an object of the present invention to provide a low pressure mercury vapor discharge lamp capable of firmly adhering a mercury-releasing substrate to the inside face of a bulb and a method for manufacturing such a low pressure mercury vapor discharge lamp.

According to the present invention, a low pressure mercury vapor discharge lamp comprises a bulb and a mercury-releasing metal substrate formed in the bulb. Herein, the mercury-releasing metal substrate has an inside part crystallized in a plate form or in a granular form and a surface on which a mercury-rich layer is formed.

It is preferable in the above-mentioned discharge lamp that the mercury-releasing metal substrate is an alloy of zinc and mercury.

It is preferable in the above-mentioned method that the content of mercury included in said alloy of zinc and mercury is in the range of 40 to 60 weight %. If the content of mercury is less than 40 weight %, the alloy is not adhered to the inside face of the bulb or only weakly adhered to the inside face of the bulb. Consequently, it is difficult to place the alloy one at a time in the process of manufacturing the low pressure mercury vapor discharge lamp.

It is preferable in the above-mentioned discharge lamp that the weight ratio of mercury to zinc is approximately 1:1.

It is preferable that the above-mentioned discharge lamp further comprises a flare part at the end of the bulb, and a cavity is formed at the junction between the bulb and the flare part, with the mercury-releasing metal substrate adhered to the cavity.

It is preferable in the above-mentioned discharge lamp that the mercury-releasing metal substrate is present in an amount of 0.02 to 0.028 mg per 1 $cm^3$ of space within the bulb.

It is preferable in the above-mentioned discharge lamp that plate crystals are formed inside the mercury-releasing metal substrate and granular crystals are formed on the surface of the mercury-releasing metal substrate.

It is preferable in the above-mentioned discharge lamp that the mercury-rich layer is partially formed on the surface of the mercury-releasing substrate.

Next, according to the present invention, the method for manufacturing the low pressure mercury vapor discharge lamp comprises the steps of putting a mercury-releasing metal substrate into a bulb; forming a mercury-rich layer on the surface of the mercury-releasing metal substrate while crystallizing the inside of the mercury-releasing metal substrate in a plate form or in a granular form by heating the bulb from the outside; and then softening the mercury-releasing metal substrate to adhere it to the inside face of the bulb.

It is preferable in the above-mentioned method that the mercury-releasing metal substrate is an alloy of zinc and mercury.

It is preferable in the above-mentioned method that the weight ratio of mercury to zinc is approximately 1:1.

It is preferable that the above-mentioned method comprises the steps of further providing a flare part at the end of the bulb; forming a cavity at the junction between the bulb and the flare part; and heating and softening the mercury-releasing metal substrate to adhere it to the cavity.

It is preferable in the above-mentioned method that mercury is seeps to the surface of crystals by heating to form the mercury-rich layer.

It is preferable in the above-mentioned method that the mercury-releasing metal substrate's surface is etched with acid.

It is preferable in the above-mentioned method that the mercury-releasing metal substrate is heated so that the graph describing the relationship between the heating time t (seconds) and the bulb temperature T (° C.) passes through a region defined by coordinates (0, 200), (60, 360), (120, 380), (80, 420), (40, 405), (10, 380) and (0, 300) before reaching a region defined by coordinates (120, 380), (240, 380), (210, 420), and (80, 420).

It is preferable in the above-mentioned method that the mercury-releasing metal substrate is heated so that the graph describing the relationship between the heating time t (seconds) and the bulb temperature T (° C.) passes through a region defined by coordinates (120, 200), (1020, 380), (90, 380), (60, 405), (10, 400), (0, 300), and (0, 200) before reaching a region defined by (1020, 380), (90, 380), (60, 405), (120, 420) and (1020, 420).

According to the present invention, a low pressure mercury vapor discharge lamp comprises a bulb and a mercury-releasing metal substrate formed in the bulb. Herein, the mercury-releasing metal substrate has an inside part crystallized in a plate form or in a granular form and a surface on which a mercury-rich layer is formed. Thus, the mercury-releasing metal substrate can be firmly adhered to the inside face of the bulb.

Furthermore, according to the present invention, the method for manufacturing a low pressure mercury vapor discharge lamp comprises the steps of putting a mercury-releasing metal substrate into a bulb; forming a mercury-rich layer on the surface of the mercury-releasing metal substrate while crystallizing the inside of the mercury-releasing metal substrate in a plate form or in a granular form by heating the bulb from the outside; and softening the mercury-releasing metal substrate to adhere it to the inside face of the bulb. Thus, the area in which the inside face of the bulb is in contact with the mercury-releasing metal substrate can be increased and the mercury-releasing metal substrate can be firmly adhered to the inside face of the bulb.

Furthermore, according to another method for manufacturing a mercury vapor discharge lamp of the present invention, a mercury-releasing metal substrate whose surface is etched with acid is used. Thus, heating conditions for adhering the mercury-releasing substrate to the inside face of the bulb can be relaxed.

DETAILED DESCRIPTION OF THE INVENTION

Hereinafter, the present invention will be described by way of embodiments with reference to drawings.

Figure 3:
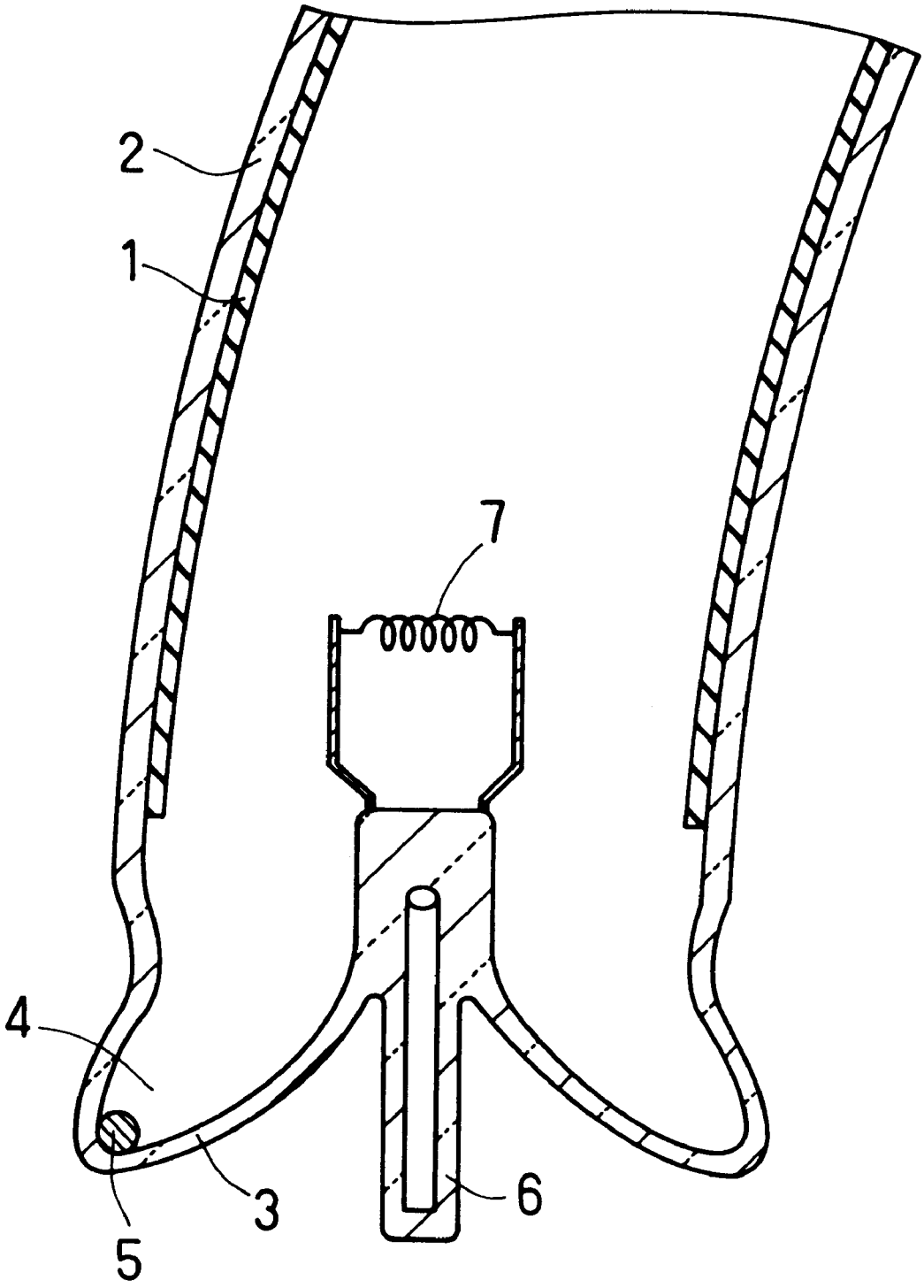
FIG. 3 is a cross-sectional view showing a main part of a fluorescent lamp according to one embodiment of the present invention.

FIG. 3 is a cross sectional view showing a main part of a circular fluorescent lamp that is one example of the low pressure mercury vapor discharge lamp according to the present invention. In this circular fluorescent lamp shown in FIG. 3, a cavity 4 is formed at the junction between the end of a glass bulb 2 provided with a phosphor layer 1 on its inside face and the end of a flare part 3 of a glass stem. An alloy 5 of zinc and mercury, which is a mercury-releasing metal substrate, is adhered to this cavity 4. The glass stem is provided with an exhaust-pipe (vacuum pipe) 6. The alloy 5 is a spherical grain having a weight of about 14 mg and the weight ratio of zinc to mercury of 1:1. The volume of this circular fluorescent lamp is about 500 $cm^3$. Moreover, in FIG. 3, numeral 7 denotes an electrode.

Next, the method for manufacturing the low pressure mercury vapor discharge lamp of the present invention will be described with reference to FIG. 3.

In FIG. 3, after a bending step, namely, a step in which the bulb 2 is heated to bend in a circular shape, the alloy 5 is introduced into the bulb 2 from the exhaust-pipe 6. After the step in which air in the bulb is evacuated to produce a vacuum so that the degree of vacuum reaches $1\times10^{-3}$ Pa, the alloy 5 is moved so that it is in place in the cavity 4. Then, the circular bulb is put into a heating furnace, followed by heating the vicinity of the cavity 4. Thus, the alloy 5 is adhered firmly to the cavity part 4. Subsequently, the circular fluorescent lamp can be obtained by this general method.

Next, the heating conditions by which such an alloy of zinc and mercury is adhered to the inside face of the bulb will be described.

Figure 4:
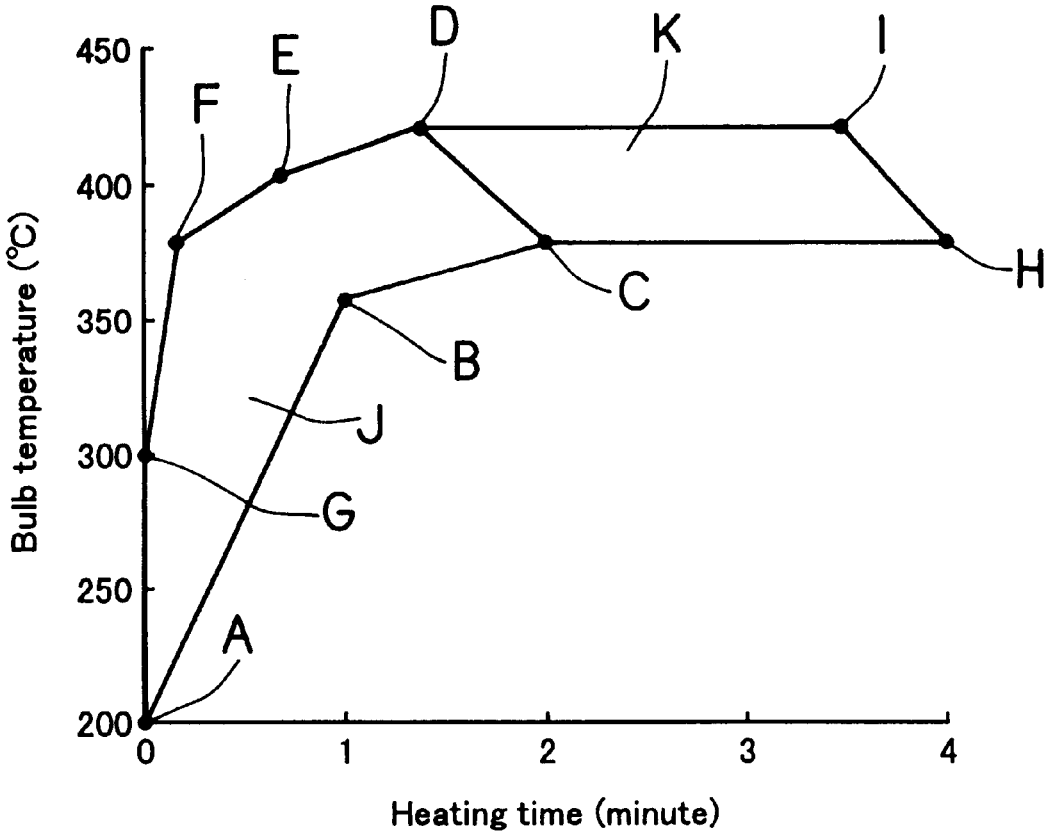
FIG. 4 is a graph showing the relationship between the heating time and the bulb temperature according to one embodiment of the present invention.

FIG. 4 is a graph showing the relationship between the heating time and the bulb temperature of the circular bulb in the heating furnace. Herein, the bulb temperature denotes a temperature of the outside face of the bulb 2 or the flare part 3 in the vicinity of the cavity 4. The temperature is equal to that of the alloy 5. In a case where the bulb is heated so that the graph of FIG. 4 passes a region J defined by the points A, B, C, D, E, F and G before reaching the region K defined by the points C, H, I and D, the alloy 5 was firmly adhered to the cavity 4. However, in a case where the bulb is heated so that the graph passes through other regions, the alloy 5 was not firmly adhered to the cavity 4 or was insufficiently adhered to the cavity 4. Each of the points A to I of FIG. 4 is shown in Table 1.

TABLE 1

| Points | A | B | C | D | E | F | G | H | I |
|---|---|---|---|---|---|---|---|---|---|
| Heating time (second) | 0 | 60 | 120 | 80 | 40 | 10 | 0 | 240 | 210 |
| Bulb temperature (° C.) | 200 | 360 | 380 | 420 | 405 | 380 | 300 | 380 | 420 |

Figure 1:
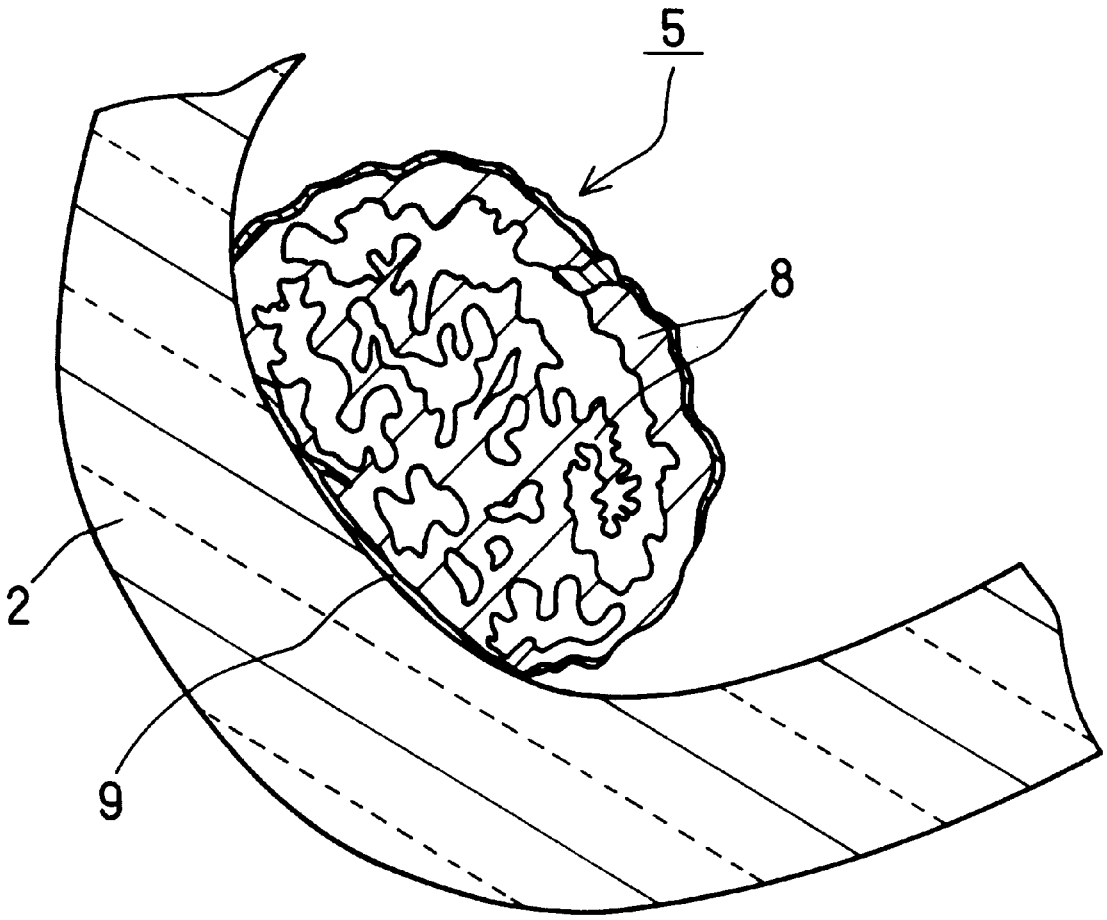
FIG. 1 is a cross-sectional view showing a state in which an alloy of zinc and mercury is adhered to the inside face of a bulb according to one embodiment of the present invention.
Figure 2:
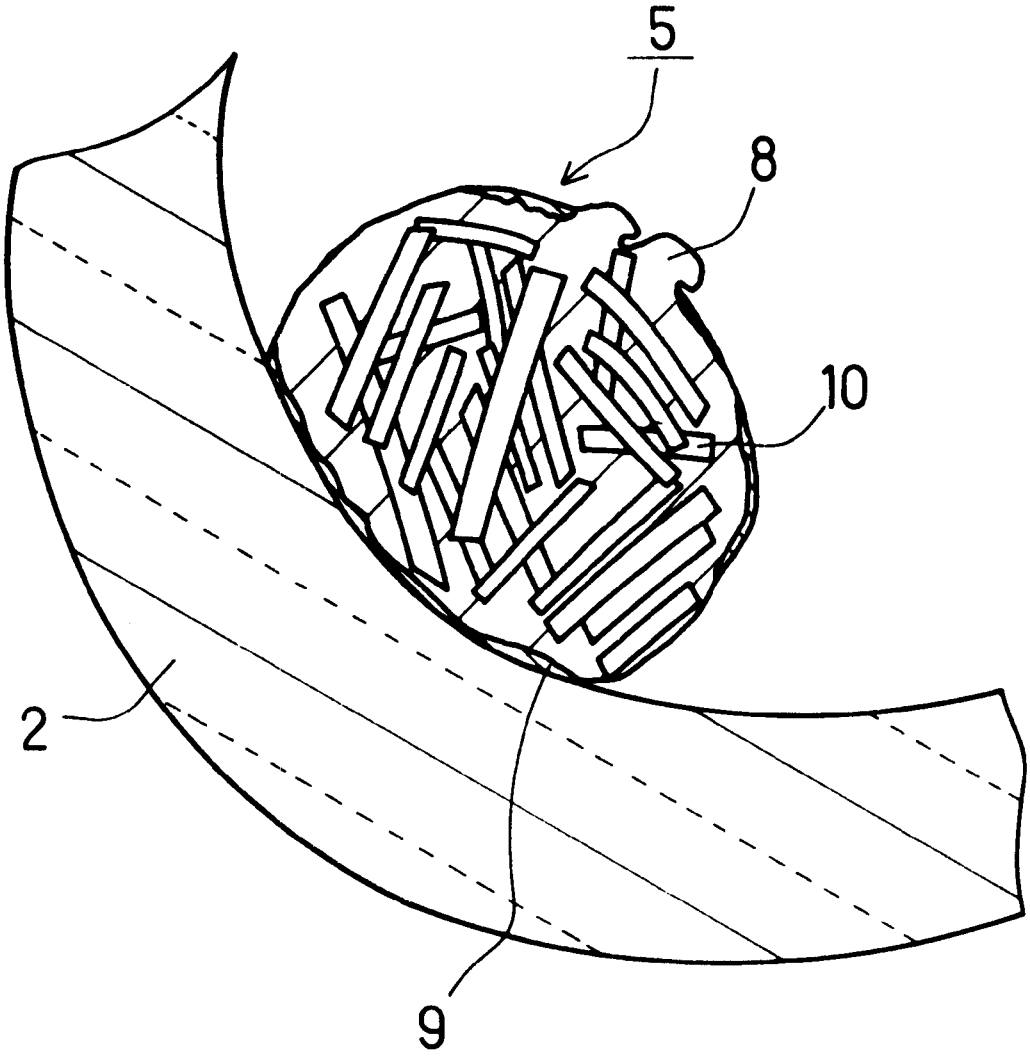
FIG. 2 is a cross-sectional view showing a state in which an alloy of zinc and mercury is adhered to the inside face of a bulb according to another embodiment of the present invention.

FIGS. 1 and 2 are cross sectional views showing the state where an alloy 5 is adhered to the inside face of the bulb 2 by the manufacturing method of the present invention. The cross sectional view is a result analyzed by using a scanning electron microscope and an electron beam probe micro-analyzer.

In FIG. 1, both the inside and surface of the alloy 5 comprise granular crystals 8. In the grain boundary part and the surface of the alloy 5, a great amount of mercury is distributed. Hence, a mercury-rich layer 9 is formed on the surface of the alloy 5.

In FIG. 2, plate crystals 10 are formed inside the alloy 5 and granular crystals 8 are formed on the surface of the alloy 5. A great amount of mercury is distributed over part of the surface of the alloy. A so-called mercury-rich layer 9 is formed on part of the surface of the alloy 5.

Thus, in the state where the alloy 5 firmly is adhered to the inside face of the bulb 2, plate crystals 10 or granular crystals 8 are formed inside of the alloy 5, and the mercury-rich layer 9 is formed on the surface. This mercury-rich layer 9 is formed in the process in which the alloy 5 is heated to release mercury. In more detail, it is formed in the process in which the inside state of the alloy 5 changes from the plate crystal 10 to the granular crystal 8 while the mercury in the alloy seeps out to the surface of the alloy 5. The alloy 5, which is liable to be softened, is softened along the surface of the bulb 2, so that the alloy can be firmly adhered to the bulb.

In a case where the temperature rising rate (the increase in the bulb temperature per unit time) is low during the heating step, the amount of mercury evaporating from the surface of the alloy is more than the amount of the mercury seeping out to the surface of the allow from the inside of the grain boundary. Consequently, a zinc-rich layer is formed on the surface of the alloy and the entire alloy is not sufficiently softened and is not adhered to the bulb. On the contrary, in a case where the temperature rising rate is high, mercury inside the grain boundary rapidly evaporates, causing a fracture. Therefore, as shown in FIG. 4, in order to obtain the stable adhering conditions, the predetermined temperature rising rate is necessary.

Next, another method for manufacturing the low pressure mercury vapor discharge lamp according to the present invention will be described.

After a bending step, the alloy 5 whose surface is etched with dilute hydrochloric acid solution for about 10 seconds is introduced into the bulb 2 from the exhaust-pipe 6. Herein, the dilute hydrochloric acid is a mixed solution of hydrochloric acid and water in the volume ratio of 1:5. An oxide film formed on the surface of the alloy 5 can be removed by this etching step. After the step in which air in the bulb is evacuated to produce a vacuum, the alloy 5 is moved so that it is in place in the cavity 4, and then the circular bulb is introduced into the heating furnace, followed by heating the vicinity of the cavity 4. Thus, the alloy 5 is adhered firmly to the cavity part 4.

Next, the heating conditions required for adhering the alloy 5 will be described.

Figure 5:
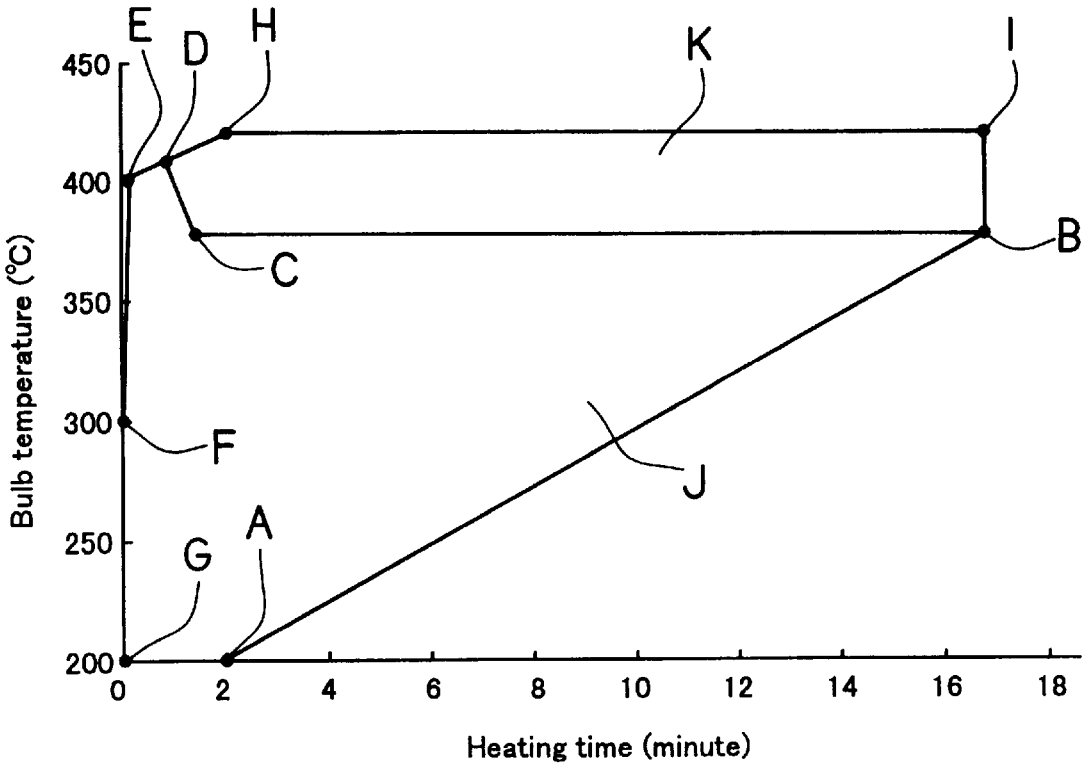
FIG. 5 is a graph showing the relationship between the heating time and the bulb temperature according to another embodiment of the present invention.

FIG. 5 is a graph showing the relationship between the heating time and the bulb temperature of the circular bulb in the heating furnace. In a case where the bulb is heated so that the graph of FIG. 5 passes the region J defined by the points A, B, C, D, E, F and G before reaching the region K defined by the points C, H, I and D, the alloy 5 was firmly adhered to the cavity 4. However, in a case where the bulb is heated so that the graph passes through other regions, the alloy 5 was not firmly adhered to the cavity 4. Each of the points of points A to I of FIG. 4 is shown in Table 2.

TABLE 2

| Points | A | B | C | D | E | F | G | H | I |
|---|---|---|---|---|---|---|---|---|---|
| Heating time (second) | 120 | 1020 | 90 | 60 | 10 | 0 | 0 | 120 | 1020 |
| Bulb temperature (° C.) | 200 | 380 | 380 | 405 | 400 | 300 | 200 | 420 | 420 |

In FIG. 5, the region in which the alloy 5 is adhered firmly to the bulb 2 can be enlarged as compared with the case of FIG. 4. This is thought to be because an oxide film having a low mercury concentration inhibits the change of the crystalline state inside the alloy 5 due to the release of mercury and softening of the alloy 5. The alloy 5 can be firmly adhered in a wide range of heating conditions by removing the oxide film by etching the surface of the alloy 5. Consequently, the adhering conditions can be relaxed during the manufacturing step, and manufacturing yield can be improved. The cross sectional view of the alloy 5 whose surface is etched and adhered is similar to those of FIGS. 1 and 2. Consequently, an area where the alloy is in contact with the bulb 2 is increased and the alloy is adhered to the bulb 2 more firmly and stably as compared with the case of the conventional method. Moreover, the above-mentioned heating time is preferably four minutes or less.

Moreover, in the above-mentioned embodiments, the case of a circular fluorescent lamp was described. However, in a different type of the low pressure vapor discharge lamp, for example, a straight tube type fluorescent lamp, the same effect can be obtained.

Moreover, in the above-mentioned embodiments, the case where the weight of the alloy of zinc and mercury was about 14 mg and the content of mercury was about 7 mg was described. However, in a case where the weight of the alloy of zinc and mercury is in the range of 10 to 14 mg and the content of mercury is in the range of 5 to 7 mg, the same effect can be obtained by using the same heating conditions as those of FIGS. 4 and 5.

Finally, it is understood that the invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. A low pressure mercury vapor discharge lamp comprising a bulb and a mercury-releasing metal substrate provided in said bulb, wherein said mercury-releasing metal substrate has a surface on which a mercury-rich layer is formed, wherein plate crystals are formed inside the mercury-releasing metal substrate and granular crystals are formed on the surface of the mercury-releasing metal substrate.

2. The low pressure mercury vapor discharge lamp according to claim 1, wherein said mercury-releasing metal substrate is an alloy of zinc and mercury.

3. The low pressure mercury vapor discharge lamp according to claim 2, wherein the content of mercury included in said alloy of zinc and mercury is in the range of 40 to 60 weight %.

4. The low pressure mercury vapor discharge lamp according to claim 2, wherein the weight ratio of mercury to zinc is approximately 1:1.

5. The low pressure mercury vapor discharge lamp according to claim 1, further comprising a flare part at an end of said bulb, wherein a cavity is formed at the junction between said bulb and said flare part and the mercury-releasing metal substrate is adhered to said cavity.

6. The low pressure mercury vapor discharge lamp according to claim 1, wherein the mercury-releasing metal substrate is present in an amount of 0.02 to 0.028 mg per 1 $cm^3$ of space within the bulb.

7. The low pressure mercury vapor discharge lamp according to claim 1, wherein the mercury-rich layer is formed on part of the surface of the mercury-releasing metal substrate.

8. A method for manufacturing a low pressure mercury vapor discharge lamp, comprising the steps of putting a mercury-releasing metal substrate into a bulb; forming a mercury-rich layer on the surface of said mercury-releasing metal substrate while crystallizing the inside of said mercury-releasing metal substrate in a form selected from the group consisting of a plate form and a granular form by heating the bulb from the outside; and softening said mercury-releasing metal substrate to adhere it to the inside face of said bulb.

9. The method according to claim 8, wherein said mercury-releasing metal substrate is an alloy of zinc and mercury.

10. The method according to claim 9, wherein the weight ratio of mercury to zinc is approximately 1:1.

11. The method according to claim 8, comprising the steps of further providing a flare part at the end of the bulb; forming a cavity at the junction between said bulb and said flare part; and heating and softening the mercury-releasing metal substrate to adhere it to said cavity.

12. The method according to claim 11, wherein mercury seeps out to the surface of the crystals by heating to form the mercury-rich layer.

13. The method according to claim 8, wherein the surface of the mercury-releasing metal substrate is etched with acid.

14. The method according to claim 8, wherein the mercury-releasing metal substrate is heated so that a graph describing the relationship between the heating time t (seconds) and the bulb temperature T (° C.) passes through a region defined by coordinates (0, 200), (60, 360), (120, 380), (80, 420), (40, 405), (10, 380) and (0, 300) before reaching a region defined by (120, 380), (240, 380), (210, 420), and (80, 420).

15. The method according to claim 13, wherein the mercury-releasing metal substrate is heated so that a graph describing the relationship between the heating time t (seconds) and the bulb temperature T (° C.) passes through a region defined by coordinates (120, 200), (1020, 380), (90, 380), (60, 405), (10, 400), (0, 300), and (0, 200) before reaching a region defined by (1020, 380), (90, 380), (60, 405), (120, 420) and (1020, 420).

* * * * *